United States Patent [19]

Reber

[11] Patent Number: 4,981,270

[45] Date of Patent: Jan. 1, 1991

[54] PAPER SHREDDING MACHINE

[75] Inventor: Joseph A. Reber, Greensburg, Pa.

[73] Assignee: John W. Wagner, New Alexandria, Pa.

[21] Appl. No.: 289,742

[22] Filed: Dec. 27, 1988

[51] Int. Cl.[5] ..... B02C 18/00

[52] U.S. Cl. ..... 241/166; 241/236

[58] Field of Search ..... 241/166, 167, 236

[56] References Cited

U.S. PATENT DOCUMENTS

| | | | |
|---|---|---|---|
| 3,845,907 | 11/1974 | Schwarz | 241/236 X |
| 4,562,971 | 1/1996 | Schwelling | 241/236 |
| 4,688,730 | 8/1987 | Dahle | 241/166 |
| 4,717,085 | 1/1988 | Crane | 241/236 |
| 4,729,515 | 3/1988 | Wagner | 241/236 X |
| 4,830,295 | 5/1989 | Schwelling | 241/236 |

*Primary Examiner*—Timothy V. Eley

*Attorney, Agent, or Firm*—James L. Sherman

[57] ABSTRACT

A shredding machine is for shredding paper or the like and includes a pair of parallel, spaced-apart shafts which rotate in opposite directions. Each of the shafts includes a plurality of cutting discs mounted thereon for rotation therewith. The cutting discs on one shaft extend between the cutting discs on the other shaft for producing cooperative longitudinal cuts of paper passing therebetween. The cutting discs include a cylindrical outer surface which is interrupted by a plurality of notches. Each of the notches has a trailing transverse surface which intersects the cylindrical outer surface at a transverse cutting edge to form a cutting angle therebetween. The cutting angle is less than forty degrees. The cutting discs on one shaft are oriented with respect to the cutting discs on the other shafts to cause the cutting angle on each of the cutting discs to be aligned with the cylindrical outer surface of the adjacent cutting discs on the outer shaft just prior to overlapping thereof. The cutting angle approaches the cylindrical outer surface generally perpendicular at the overlapping to cause the transverse cutting edge to produce a transverse cut of the paper therebetween. There is also provided a preferred method for producing the cutting discs of the shredding machine.

10 Claims, 2 Drawing Sheets

PAPER SHREDDING MACHINE

BACKGROUND OF THE INVENTION

1. Field of the Invention

This invention relates to a paper shredding machine and, more specifically, to such a paper shredding machine which is capable of cutting the paper into elongated strips while providing a transverse cut to further reduce the size of the resulting pieces of paper. The invention also includes the method of making the cutting discs of such a paper shredding machine.

2. Description of the Prior Art

It is not uncommon in the paper shredding art to provide various types of paper shredders which generally cut or shred the paper into a plurality of elongated strips. Typically, such shredding machines include first and second parallel spaced-apart rotatable shafts. The shafts are driven to rotate in opposite directions. There is included a plurality of cutters or cutting discs having annular cutting surfaces disposed on each shaft and locked against rotation on the shaft by locking means. The adjacent cutters on each shaft are separated by a cutter on the other shaft extending therebetween. Additionally, combers are interposed between the cutters to direct the paper between the shafts and the interfitting cutters thereof and to further direct the resulting strips to a discharge area. The cutting action between the interfitting cutters tends to slice the paper as the side edges of the cutters pass by one another in opposite directions. U.S. Pat. Nos. 2,770,302; 3,630,460; 3,797,765; and 4,018,392 disclose shredding machines of this general type which are well known in the paper shredding art.

There are additional shredding machines in the prior art which include cutting wheels or discs which, although primarily cutting at the side edges thereof, include notches or grooves at the outer surface of the discs. These notches or grooves are primarily intended to grip the paper supplied thereto rather than to produce any transverse cutting of the strips formed by the shredder. U.S. Pat. Nos. 3,033,064; 3,921,920; and 4,194,698 disclose such paper shredders with notched wheels which do not proport to produce any transverse cut of the elongated strip formed by passage of the paper therethrough.

Although the various paper shredders disclosed in the patents mentioned hereinabove have been successfully employed, it has been found that even the production of such narrow, elongated strips does not necessarily satisfy the security requirements of numerous businesses and governmental agencies. Simply reducing the paper to narrow, elongated strips would not necessarily prevent reconstruction of a document shredded in these types of machines. As a result, there remains a need for a paper shredder which is capable of further reducing the size of the resultant pieces for security reasons. Further reducing the size of the elongated strips by introducing a plurality of transverse cuts tends to make reconstruction of an original document almost, if not completely, impossible.

U.S. Pat. Nos. 4,257,565 and 4,565,330 disclose shredding devices which produce longitudinal cuts for the formation of elongated strips and further include transverse notches or teeth which are designed to produce a transverse cut of these elongated strips. However, both of these devices recognize the difficulty of producing any form of notch or tooth in the periphery of such a cutting disc which will, by itself, produce the desired transverse cut. Accordingly, both of these shredding devices include the cutting discs thereof which are aligned to cooperate with combers or spacer members between the cutters on the other for pinching or severing of the paper as the paper passes between the notches or teeth and the end of the comber or spacer member. Basically, these shredding machines include a pair of rotary shafts driven in opposite directions. A plurality of rotary discs are mounted on the rotary shafts and have a plurality of shredding blades or teeth about the outer periphery thereof. A plurality of spacer members, which are aligned with the rotary disc and located between adjacent discs on the opposite shaft, include at least one cutting edge or surface which engages with the shredding blade of the rotary disc so that paper trying to pass through a gap therebetween will be severed or cut.

In an effort to further reduce the size of the resulting pieces of paper produced by a paper shredder, U.S. Pat. No. 3,860,180 discloses apparatus and method for further cutting the strips with a transverse incision which is oblique to the path of the longitudinal strips formed thereby. The shredding machine disclosed therein includes a pair of counter-rotating cutter rollers which include axially-spaced cutter discs having radial side faces and a generally cylindrical periphery outer edge. The cutter discs of each roller fit closely between the cutter discs of the other roller so that the side edges of adjacent pairs of cutter discs form a slitter. There is included means on the circumference of each cutter disc including the trailing edge of at least one generally axially extending notch formed in the outer periphery of the cutting disc to form a transverse interruption in the strips of the document being cut by the adjacent slitters. Each of the notches is inclined from side to side and is displaced circumferentially from the notch in adjacent cutter discs on the same shaft in such a manner that the notches of all of the cutter discs of each roller defines at least one helical groove in the periphery of the respective roller. As a result, the longitudinal strips being formed are further reduced into short sections by making transverse incisions in the document which extends obliquely from the path of one slit to the path of an adjacent slit.

As will be seen, simply providing some form of generally transversely extending notch or tooth to a cutter wheel will not insure that a transverse cut will be produced in the strips formed during the shredding. While the longitudinal strips of paper tend to propagate as the sheets are passing between the cutting discs, propagation in a transverse direction is not as easily produced. In fact, with some configurations, it is not possible to produce a transverse cut in a piece of paper near the ends of longitudinal cuts. Some notch or tooth configurations have been found to simply "push" the paper in such a manner that further propagation of the longitudinal cuts occurs. With further propagation of the longitudinal cuts, the paper would simply move away from the transverse notch or tooth and would not be sufficiently supported to allow a transverse cut to be formed.

On the other hand, it should be recognized that the cutting discs of U.S. Pat. No. 3,860,180 include the notches which are formed at an oblique angle so that the transverse cutting initially occurs at one side of the strip for easier propagation to the other side of the strip.

However, formation of the cutting wheels with an obliquely formed notch or tooth therein significantly complicates the manufacturing process of the rollers and the various cutting discs thereof.

As seen in British Pat. No. 2,098,502, a shredding apparatus employing the inclined or oblique notches of the type described in U.S. Pat. No. 3,860,180 further includes additional teeth for proper gripping and support of the paper passing therethrough. Basically, the shredding device disclosed therein includes two driven and intermeshed cutting rollers which are formed by cutting discs which have recesses formed therein. The recesses extend in a generally transverse direction and are formed in the surface of each cutting disc. These recesses, which are not the oblique cutting notches, form an inclined saw-tooth profile which also continues in the adjacent cutter discs in the form of a turned or helical profile in the same manner as the oblique cutting notches. These recesses are intended to grip individual sheets of a stack of paper and further insure proper retention of the paper through the cutter discs in order to produce the longitudinal and transverse cuts thereof.

German Laid Open Patent Appln. No. 32 39 060 Al discloses a series of overlapping cutting discs for a basic longitudinal cut but further includes a complicated series of notches in the surfaces thereof. As generally indicated in the drawings, the notches appear to grip or bend the strip in order to restrict its movement in an effort to allow a toothed area thereof to produce a transverse cut. Whether or not such gripping or bending will properly restrict the movement of the paper, the patent does recognize that the simple introduction of a tooth or notch to the outer edges of a cutting disc will not insure that the paper is transversely cut.

U.S. Pat. No. 3,960,335 and British Pat. No. 2,137,116A disclose additional machines which are purportedly capable of producing transverse cuts to longitudinal strips of sheet material formed therein. The device of U.S. Pat. No. 3,960,335 is primarily directed to cutting sheets of plastic. However, as those skilled in the shredding art must know, any problems experienced in cutting sheets of plastic could be quite different from those associated with cutting paper. Plastic sheets and paper sheets would have quite different propagation characteristics and a device which would cut one might not be capable of similarly cutting the other. Nevertheless, the device disclosed therein includes an elaborate series of teeth which purportedly produce numerous transverse cuts in the sheet plastic prior to the formation of the longitudinal strips as the sheets continue to advance between the side edges of the overlapping discs thereof. On the other hand, one might question the reliability or capabilities of such a configuration when additional embodiments disclosed in U.S. Pat. No. 3,960,335 are directed to the inclusion of a completely different element for producing transverse cuts of the sheet plastic after it has been longitudinally cut to form elongated strips.

Similarly, British Pat. No. 2,137,116A purports to include overlapping cutting discs which have a relatively simple notch therein. This simple notch configuration is said to be able to produce a transverse cut. However, considering the problems associated with producing such a transverse cut in paper material, it is difficult to see how the notch configuration disclosed therein would be any different than the numerous notch configurations which did not produce a transverse cut in the shredding devices which were discussed hereinabove as primarily directed to the formation of simple, elongated strips.

All of the above-mentioned patents are incorporated herein by reference as if the entire contents thereof were fully set forth herein.

Although numerous attempts have been made to provide a simple and efficient shredding machine for cutting paper inserted therein into extremely small pieces, there remains a need for any such machine which is reliable, effective, and inexpensive to provide.

OBJECTS OF THE INVENTION

It is therefore an object of the invention to provide a shredding machine which is capable of cutting paper inserted therein into small pieces.

It is a further object to provide such a shredding machine which produces relatively short elongated strips of paper which are cut in a transverse direction to establish their overall length.

It is another object to provide such a machine which is efficient, reliable and inexpensive to provide.

It is still another object of the invention to provide a method of manufacturing the cutting discs for such a machine which is simple and economical.

SUMMARY OF THE INVENTION

These and other objects of the invention are provided in a preferred shredding machine for shredding paper or the like including a pair of parallel, spaced-apart shafts. The pair of shafts are rotated in opposite directions. Each of the shafts includes a plurality of cutting discs mounted thereon for rotation therewith. Each of the cutting discs on one of the shafts extends between adjacent cutting discs on the other shaft. Each of the cutting discs has side edges to produce a longitudinal cut of the paper between corresponding side edges of the adjacent cutting discs on the other shaft as the paper passes between the shafts. Each of the cutting discs has a cylindrical outer surface which is interrupted by a plurality of notches. Each of the notches has a trailing transverse surface which intersects the cylindrical outer surface at a transverse cutting edge to form a cutting angle therebetween. The cutting angle formed between the trailing transverse surface and the cylindrical outer surface is less than about forty degrees. The cutting angle of each of the notches on each of the cutting discs on one of the shafts is aligned with the cylindrical outer surface of each of the adjacent cutting discs on the other shaft prior to overlapping thereof during the rotation of the discs. The cutting angle of the each of the notches approaches the cylindrical outer surface generally perpendicularly at the overlapping to cause the transverse cutting edge to produce the transverse cut of the paper therebetween.

Another aspect of the invention resides broadly in a method of making cutting discs for a shredding machine for shredding paper of the type which includes a pair of parallel, spaced-apart shafts which rotate in opposite directions. Each of the shafts includes a plurality of the cutting discs mounted thereon for rotation therewith. Each of the cutting discs on one of the shafts extends between adjacent the cutting discs on the other of the shafts. Each of the cutting discs on one of the shafts cooperate with the cutting discs on the other of the shafts to produce longitudinal and transverse cutting of the paper being passed therebetween. The method comprises the steps of: cutting blank discs from tool steel bar stock; punching a hole through the blank discs for mounting on one of the shafts; mounting a stack of the blank discs on a mandrel; turning the stack of the blank discs to form an outer cylindrical surface having a sized outer diameter; and milling a plurality of transverse notches in the stack in each of the blank discs thereof with a convex milling cutter to provide a rounded base and a trailing surface for each of the notches, which the trailing surface intersects with the outer cylindrical surface at a transverse cutting edge to form a cutting angle therebetween.

Figure 1:
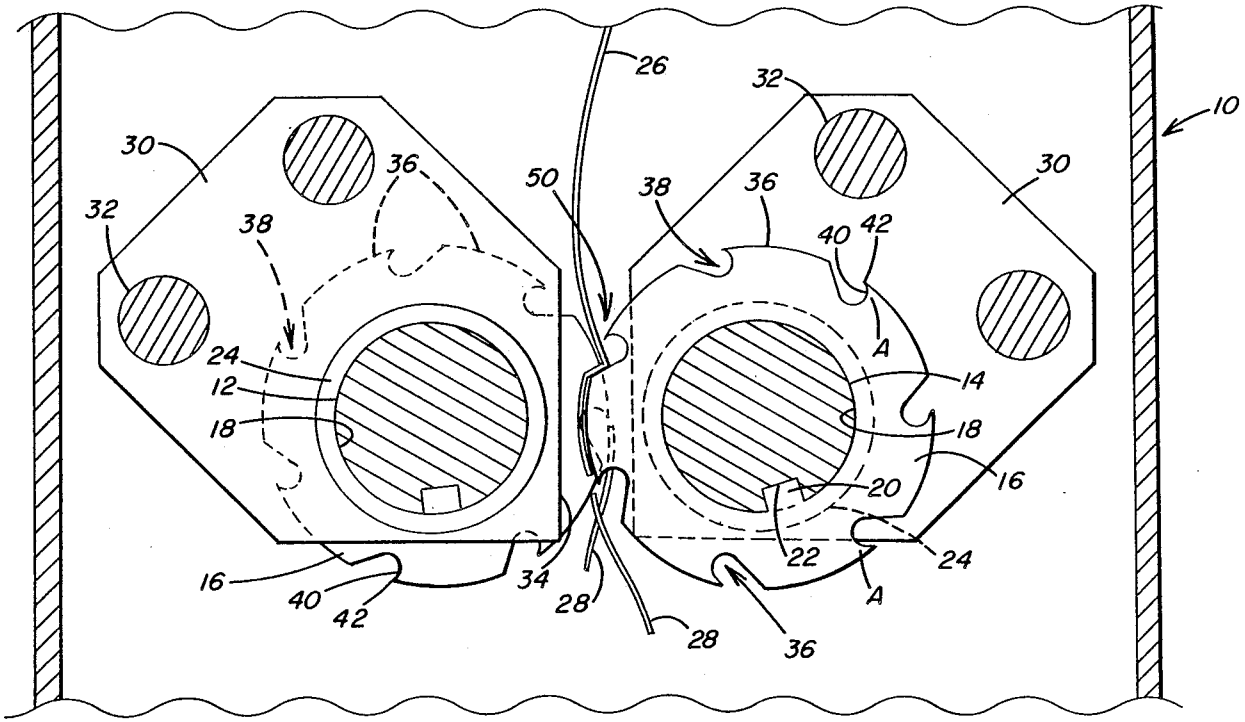
FIG. 1 is a fragmentary, sectional side view of a preferred shredding machine including various features of the invention.

FIGS. *2a* through *2d* include schematic views of the various stages of manufacture of the preferred cutting discs of the machine of FIG. 1.

DESCRIPTION OF THE PREFERRED EMBODIMENTS

As seen in FIG. 1, a preferred shredding machine 10 is of a type which includes numerous features which are similar to those disclosed in the various patents mentioned hereinabove. The shredding machine 10 includes a pair of parallel, spaced-apart shafts 12, 14. The pair of shafts 12, 14 are driven in a manner which is well known in the shredding art at the same speed, in opposite directions. Each of the shafts 12, 14 includes a plurality of cutting discs 16 mounted thereon. Each of the discs 16 includes an opening 18 with a key 20 for receipt in a keyway 22 of the shaft 12, 14. The keyway 22 of each shaft 12, 14 is helically formed to spiral around the outer surface of the shaft 12, 14 in order to produce angular indexing of each of the discs 16 on the shafts 12, 14. Slightly changing the angular position of each of the cutting discs 16 on the shaft 12, 14 is well recognized in the shredding art as a means for improving the efficiency and reliability of such a shredding machine.

Each of the cutting discs 16 on one shaft 12 extends between adjacent cutting discs 16 on the other shaft 14. To properly space the cutting discs 16 on their respective shafts 12, 14, there is included disc spacers 24 which also encircle their respective shafts 12, 14 and are located between adjacent discs 16 thereon. The spacers 24 tend to maintain the discs 16 in perpendicular alignment on the shafts and to prevent interfering contact with the cutting discs 16 on the other shaft as they pass therebetween.

There is also provided between each of the adjacent cutting discs 16 on each shaft 12, 14 a comber 30. The comber 30 generally encircles the disc spacer 24 and is provided to generally direct the paper 26 between the shafts 12, 14 in the area of the cutting discs 16. Additionally, the combers 30 prevent collection of strips or pieces of paper between the adjacent discs 16 to insure that they are all directed for collection below the cutting discs 16. Each of the combers 30 is mounted on a pair of axially extending support rods 32 which provide overall integrity for the machine 10. Each comber 30 has a face 34 in an area adjacent to its respective cutting disc 16 on the other shaft to generally define a gap therebetween. The gap restricts movement of the strips 28 formed by the cutting action of the discs 16 to insure that they will continue to pass between the shafts 12, 14 for collection therebelow.

Generally, each of the cutting discs 16 has side edges which produce a longitudinal cut of the paper 26 between corresponding side edges of the adjacent cutting discs 16 on the other shaft as the paper 26 passes between the shafts 12, 14. Accordingly, the side edges of each of the overlapping cutting discs 16 tend to produce the elongated strips 28 as the discs overlap during rotation thereof.

Additionally, each of the preferred cutting discs 16 has a cylindrical outer surface 36 which is interrupted by a plurality of notches 38. The formation of the notches 38 will be discussed in detail hereinbelow. However, it is significant that each of the notches 38 includes a trailing transverse surface 40 which intersects with the cylindrical outer surface 36 at a transverse cutting edge 42 to form a cutting angle A therebetween. Again, as will be made clear from further discussion hereinbelow, the transverse cutting edge 42 is perpendicular to the plane of the discs 16 to be generally parallel with each of the shafts 12, 14. With the cutting edge 42 being transverse, there is no angular propagation of a general transverse cut as may have been produced in the devices generally disclosed in U.S. Pat. No. 3,860,180 and British Pat. No. 2,098,502A. It has been found that a cutting angle A between the trailing transverse surface 40 and the cylindrical outer surface 36 of less than forty degrees will produce the desired transverse cut.

As should be clear from the discussion of the prior art mentioned above, simply providing some form of notch or tooth configuration to the outer surface of a cutting disc could not be expected to insure a proper transverse cut of paper passing through a shredding machine. Accordingly, while a cutting angle A of less than forty degrees appears to be significant for producing a transverse cut, it is equally significant that each of the cutting angles A of each of the notches 38 on each of the cutting discs 16 is generally aligned with the cylindrical outer surface 36 of each of the adjacent cutting discs 16 on the other shaft prior to any overlapping thereof during rotation of the disc 16. In other words, while the preferred cutting discs 16 including seven notches 38, it is also significant that the angular position of each of the cutting discs 16 is such that the notches 38 and the cutting angles A are displaced from the notches 38 on the adjacent cutting disc 16 on the other shaft. As a result, each cutting angle A is aligned between the notches 38 on the other cutting disc so that it is instead aligned with the cylindrical outer surface 36 therebetween. As a general rule, the circumferential distance or width of the notches 38 is significantly smaller than the circumferential length or width of the cylindrical outer surfaces 36 therebetween. The preferred cutting discs 16 include the cylindrical outer surfaces 36 having a cylindrical length or width which is about two and a half times as great as the circumferential width of the notches 38 therebetween.

With the cutting discs 16 properly oriented to insure that each cutting angle A intersects or passes between the adjacent cutting discs 16 on the other shaft in the area of the cylindrical outer surface 36, it is also important to provide a preferred orientation of the cutting angle A as it begins the intersection at the cylindrical outer surface 36. As best seen in area 50, the initial orientation of the cutting angle A as it approaches the cylindrical outer surface 36 is generally perpendicular thereto. With the cylindrical outer surfaces 36 of the adjacent cutting discs 16 on the other shaft generally supporting an area of the paper 28 prior to the longitudinal cutting thereof. There is no longitudinal cutting in the area because there is no overlapping of the discs at the notch 38. The perpendicular approaching of the paper 28 extended between the cylindrical outer surfaces allows the transverse cutting edge 42 to intersect the paper for the production of a transverse cut as the discs 16 continue to rotate. Generally, the approach of the cutting angle A, since it has an angle of less than forty degrees, includes the trailing transverse surface 40 intersecting the cylindrical outer surfaces 38 at an angle of about sixty five to about eighty degrees and the outer cylindrical surface 36 of the cutting disc 16 intersecting the cylindrical outer surfaces 36 of the other cutting discs 16 at an angle of about sixty five to about eighty degrees.

There is included another feature in the notch 38, which will be explained during the discussion of the manufacture of the cutting disc 16, that further improves the reliability of the cutting angle A and the ability of the cutting disc 16 to properly produce a transverse cut. Specifically, the notch 38 has a rounded base which generally extends from the transverse cutting edge 42 to the leading side of the notch 38. The rounded base tends to prevent the collection of small pieces of paper therein which would interfere with a proper transverse cut. More significantly, however, is the fact that by providing a rounded base, the portion of the cutting disc 16 generally between the trailing transverse surface 40 and the cylindrical outer surface 36 is increasing widened. In other words, the trailing transverse surface 40 forming the preferred cutting angle A with the cylindrical outer surface 36 is primarily limited to the region immediately adjacent the transverse cutting edge 42. By providing a rounded base to the notch 38, the portion of the cutting angle A remote from the transverse cutting edge 42 is increasingly widened and therefore strengthened.

In order to fully understand the operation of the preferred shredding machine 10, it is appropriate to include a number of dimensions and operating parameters. For example, the preferred cutting discs 16 have an outside diameter of about 3.2 inches and a thickness of about 0.103 inches. The cutter spacers have a thickness of about 0.102 inches to be slightly less than the cutters themselves but to nevertheless maintain the cutters in alignment for preventing undesired contact with other discs 16. The overall shredding machine 10 includes about one hundred seventeen cutting discs 16 with fifty eight cutting discs 16 on one of the shafts 12 and fifty nine cutting discs 16 on the other shaft 14. The shafts 12, 14 are about 2.810 inches apart. The faces or ends of the combers 30 are aligned to be effectively about 9/16 of an inch apart to define the general region for the flow of paper through the machine 10. Finally, each of the shafts 12, 14 is rotated at a speed of about 104 RPMs so that the surface speed at the outer edges of each of the cutter discs 16 is about 87.5 surface feet/minute.

Figure 2A:
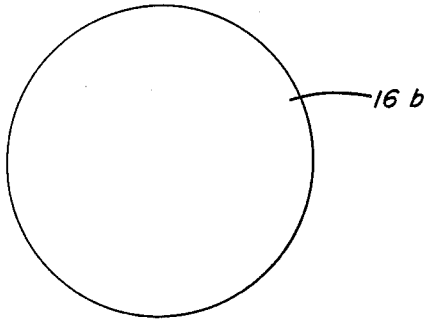
Figure 2B:
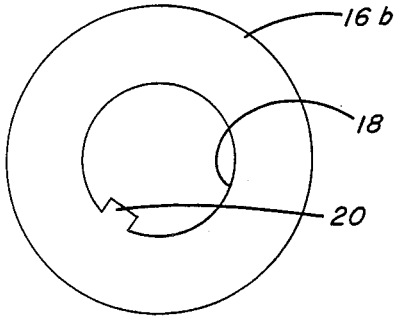
Figure 2C:
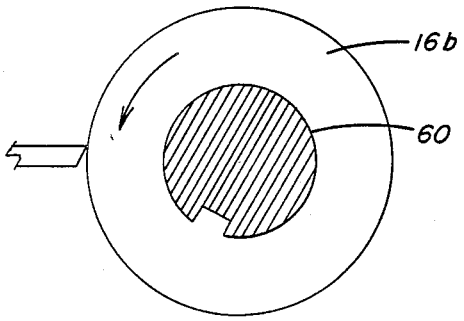
Figure 2D:
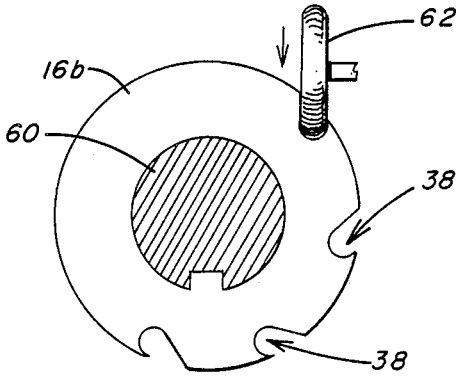

While, as mentioned above, numerous paper shredding machines purport to include cutting discs which are capable of producing a transverse cut, the cutting discs 16 of the preferred machine 10 are extremely efficient and yet are provided by a method of manufacture which is both simple and economical. In order to manufacture the preferred cutting discs 16, a 3½ inch bar stock of 4340 Tool Steel is sliced to provide blank discs **16*b* having about a 3/16 inch thickness. As seen in FIG. 2*a*, these blank discs 16*b*** are then surface ground to a thickness of about 0.140 inches.

As seen in FIG. **2*b*, the center hole 18 including the key 20 is then punched from the blank disc 16*b***.

As seen in FIG. **2*c*, an entire array of blank discs 16*b* is installed on a mandrel 60** for proper turning and cutting to reduce the overall outside diameter to a size of about 3¼ inches to provide a consistent and uniform diameter for further processing.

As seen in FIG. **2*d*, the stack or array of blank discs 16*b* on the mandrel 60 is then mounted in a milling machine. The milling machine includes a convex milling cutter 62 which is ¼ inch wide and has a semicircular outer surface or profile. The convex milling cutter 62 is advanced at an angle with respect to the array or stack of blank discs 16*b* to form the rounded base of the notch 38 and to produce the trailing transverse surface 40 as described hereinabove. The angle of the convex milling cutter 62 causes the trailing transverse surface 40 to intersect the cylindrical outer surface 36 at the above-described cutting edge 42 to form the cutting angle A therebetween. The stack of blank discs 16*b* are indexed to seven different positions in order to form seven notches 38 in each of the blank discs 16*b*** thereof.

After proper milling of the notches 38, each of the blank discs **16*b* is then heat treated to improve the hardness. A final grinding to provide an outside diameter of 3.200 inches and a thickness of 0.103 inches is performed in order to provide the finished cutting disc 16**.

U.S. Pat. No. 4,426,044; U.S. Pat. No. 4,625,925; German Patent Publication Published for Opposition Purposes No. 1 291 606; and French Pat. No. 1,226,633 disclose additional shredding machines. All of the above-mentioned patents and patent applications are incorporated herein by reference as if the entire contents thereof were fully set forth herein.

It should be clear to those skilled in the paper shredding art, that various alterations may be made to the preferred embodiments discussed hereinabove without departing from the scope of the invention as claimed.

What is claimed is:

1. A shredding machine for shredding paper comprising:

a pair of parallel, spaced-apart shafts;

each of said shafts having a central axis of rotation;

said pair of said shafts being mounted for rotation in opposite directions;

said each of said shafts including a plurality of cutting discs mounted thereon for rotation therewith;

each of said cutting discs on one of said shafts extending between adjacent said cutting discs on the other of said shafts;

said each of said cutting discs having side edges for producing a longitudinal cut of said paper between corresponding said side edges of said adjacent said cutting discs as said paper passes between said shafts;

said each of said cutting discs having a cylindrical outer surface;

said cylindrical outer surfaces of said cutting discs on said one of said shafts lying within a first common cylindrical surface coaxially aligned with said central axis of said one of said shafts;

said cylindrical outer surfaces of said cutting discs on said other of said shafts lying within a second common cylindrical surface coaxially aligned with said central axis of said other of said shafts;

said cylindrical outer surface of said each of said cutting discs being interrupted by a plurality of notches;

each of said notches having a trailing transverse surface which intersects said cylindrical outer surface at a transverse cutting edge to form a cutting angle therebetween;

said transverse cutting edge being parallel with said central axis of said each of said shafts;

said cutting angle formed by said trailing transverse surface and said cylindrical outer surface being less than forty degrees;

said cutting angle of said each of said notches on said each of said cutting discs on said one of said shafts being disposed for being aligned with said cylindrical outer surface of said each of said adjacent said cutting discs on said other of said shafts prior to overlapping thereof during said rotation of said discs;

said cutting angle of said each of said notches being disposed for approaching said cylindrical outer surface of said each adjacent said cutting disc generally perpendicular at said overlapping to cause said transverse cutting edge to produce a transverse cut of said paper therebetween;

said railing transverse surface, at said overlapping, intersecting said cylindrical outer surface of said each adjacent said cutting disc at a first intersect angle of about sixty-five to about eighty degrees; and said cylindrical outer surface at said transverse cutting edge, at said overlapping, intersecting said cylindrical outer surface of said each adjacent said cutting disc at a second intersect angle of about sixty-five to about eighty degrees.

2. The shredding machine according to claim 1, wherein said each of said cutting discs has an outside diameter of about 3.2 inches and a thickness of about 0.103 inches.

3. The shredding machine according to claim 1, wherein said cylindrical outer surface between adjacent said notches on said cutting disc has a circumferential length of at least about two and a half times a circumferential length of said notch.

4. The shredding machine according to claim 3, wherein said each of said cutting discs includes seven of said notches.

5. The shredding machine according to claim 1, wherein said each of said notches includes a rounded base.

6. The shredding machine according to claim 5, wherein said rounded base causes a portion of said cutting disc between said cylindrical outer surface and said notch to be strengthened as said portion remote from said transverse cutting edge is relatively widened.

7. The shredding machine according to claim 1, wherein said paper prior to said overlapping includes an area generally aligned with said notch of said cutting disc, said area of said paper is supported by said cylindrical outer surfaces of said adjacent said cutting discs, said area is free of said longitudinal cuts, and said transverse cut of said paper is produced in said area at a location between said cylindrical outer surfaces of said adjacent said cutting discs.

8. The shredding machine according to claim 1, wherein said cutting discs have a thickness of less than 0.140 inches.

9. The shredding machine according to claim 1, wherein said each of said cutting discs is formed of a blank disc sliced from tool steel bar stock, said notches of said cutting disc are formed by milling said blank disc, and said each of said blank discs with said notches formed therein are subjected to heat treating and finish grinding to provide said cutting disc.

10. The shredding machine according to claim 1, wherein said each of said notches includes a leading transverse surface; said leading transverse surface intersects said cylindrical outer surface at a transverse leading edge; and said trailing transverse surface, said leading transverse surface, and said transverse leading edge are parallel with said central axis of said each of said shafts.

* * * * *